US011255154B2

(12) United States Patent
Fagna et al.

(10) Patent No.: US 11,255,154 B2
(45) **Date of Patent: *Feb. 22, 2022**

(54) TANDEM RELEASABLE BRIDGE PLUG SYSTEM AND METHOD FOR SETTING SUCH TANDEM RELEASABLE BRIDGE PLUGS

(71) Applicant: ARCHER OILTOOLS AS, Stavanger (NO)

(72) Inventors: Jan-Ove Fagna, Tertnes (NO); Eirik Andre Revheim, Bru (NO)

(73) Assignee: ARCHER OILTOOLS AS, Stavanger (NO)

( * ) Notice: Subject to any disclaimer, the term of this patent is extended or adjusted under 35 U.S.C. 154(b) by 350 days.

This patent is subject to a terminal disclaimer.

(21) Appl. No.: 16/332,631

(22) PCT Filed: Sep. 13, 2017

(86) PCT No.: PCT/NO2017/050223

§ 371 (c)(1),
(2) Date: Mar. 12, 2019

(87) PCT Pub. No.: WO2018/052308

PCT Pub. Date: Mar. 22, 2018

(65) Prior Publication Data

US 2021/0277735 A1 Sep. 9, 2021

(30) Foreign Application Priority Data

Sep. 13, 2016 (NO) ..... 20161455

(51) Int. Cl.
*E21B 33/134* (2006.01)
*E21B 34/14* (2006.01)
(Continued)

(52) U.S. Cl.
CPC ..... *E21B 33/134* (2013.01); *E21B 23/06* (2013.01); *E21B 33/122* (2013.01); *E21B 34/142* (2020.05); *E21B 2200/04* (2020.05)

(58) Field of Classification Search
CPC ..... E21B 33/13; E21B 33/134
See application file for complete search history.

(56) References Cited

U.S. PATENT DOCUMENTS 2,806,532 A 9/1957 Baker et al.
2,973,035 A 2/1961 Brown
(Continued)

OTHER PUBLICATIONS

Norwegian Search Report, dated Apr. 12, 2017, for Norwegian Application No. 20161455, along with an English translation.
(Continued)

*Primary Examiner* — Kristyn A Hall
(74) *Attorney, Agent, or Firm* — Birch, Stewart, Kolasch & Birch, LLP

(57) ABSTRACT

A method of setting a tandem releasable bridge plug system in a casing includes assembling a tandem bridge plug string including a lower bridge plug on a lower, disconnectable connector, an upper bridge plug on an upper, disconnectable connector which both are initially disabled by a lock and unlockable from topsides, and running in the tandem plug string on a drill pipe string until the lower plug is at its setting target depth; setting and shutting the lower plug; disconnecting the upper plug from the lower plug; pulling up the upper plug to its upper setting target depth; enabling the upper plug by releasing the lock; setting and shutting the upper plug; disconnecting the drill pipe string from the upper plug.

20 Claims, 6 Drawing Sheets

(51) Int. Cl.
*E21B 23/06* (2006.01)
*E21B 33/122* (2006.01)

(56) References Cited

U.S. PATENT DOCUMENTS 3,410,348 A * 11/1968 Page ..... E21B 33/1295 166/120
3,455,381 A * 7/1969 Page, Jr. ..... E21B 23/06 166/121
4,794,989 A 1/1989 Mills
4,928,762 A 5/1990 Mamke
5,020,597 A 6/1991 Braddick et al.
5,826,652 A * 10/1998 Tapp ..... E21B 23/06 166/120
9,279,307 B2 3/2016 Wiliiamson
10,822,915 B2 * 11/2020 Fagna ..... E21B 23/02
2004/0050546 A1 3/2004 Tinker
2004/0251024 A1 12/2004 Jones
2010/0038096 A1 * 2/2010 Reimert ..... E21B 23/06 166/382
2014/0332205 A1 11/2014 Harrington et al.
2019/0040699 A1 * 2/2019 Perez ..... E21B 23/06
2019/0120006 A1 * 4/2019 McCarthy ..... E21B 33/128
2019/0203550 A1 * 7/2019 Geoffroy ..... E21B 33/1285

OTHER PUBLICATIONS

International Preliminary Report on Patentability, issued in PCT/NO2017/050223, dated Nov. 5, 2018.
International Search Report, issued in PCT/NO2017/050223, dated Jan. 8, 2018.
Written Opinion of the International Searching Authority, issued in PCT/NO2017/050223, dated Jan. 8, 2018.

* cited by examiner

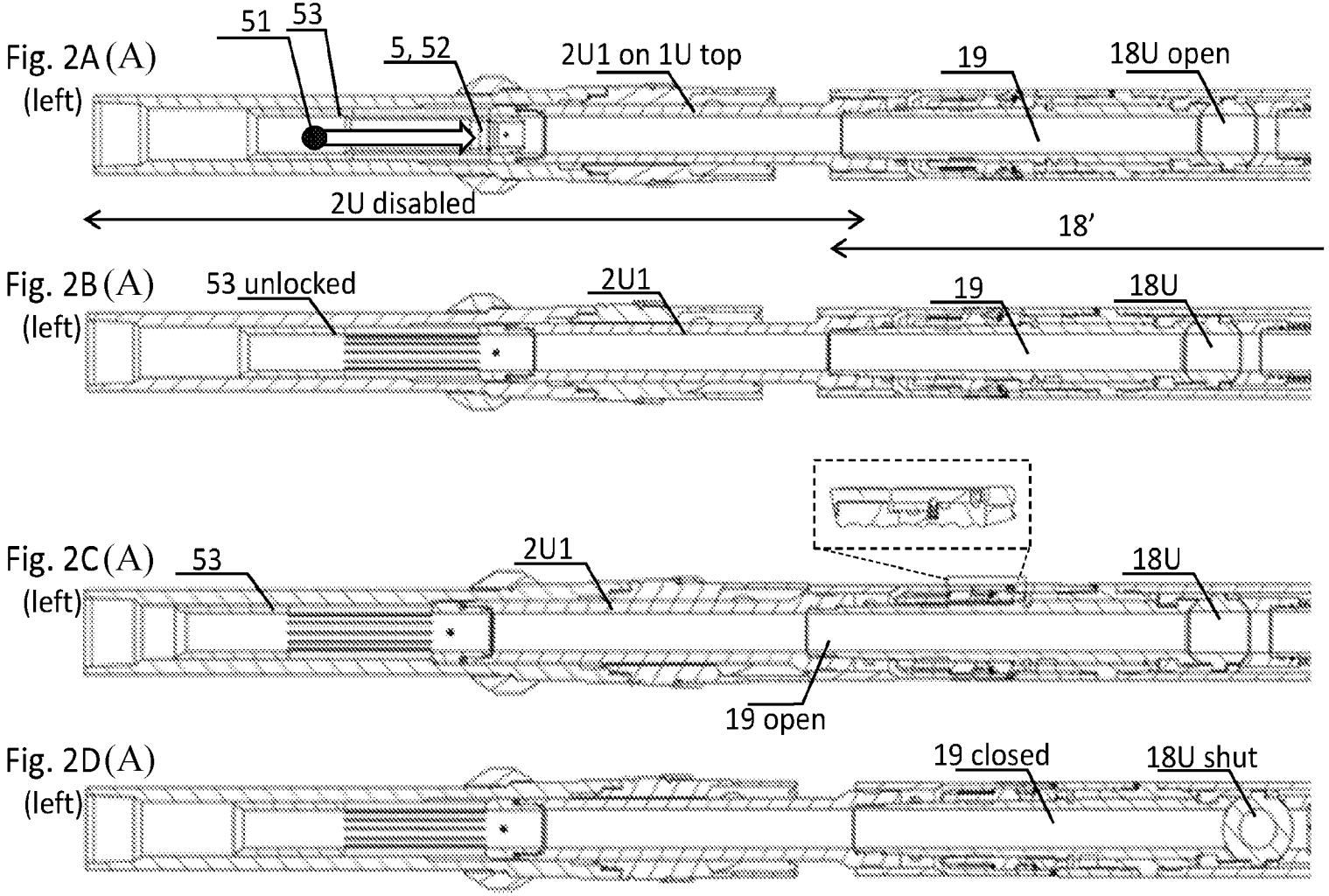
Fig. 2A (A) (left)
Fig. 2B (A) (left)
Fig. 2C (A) (left)
Fig. 2D (A) (left)

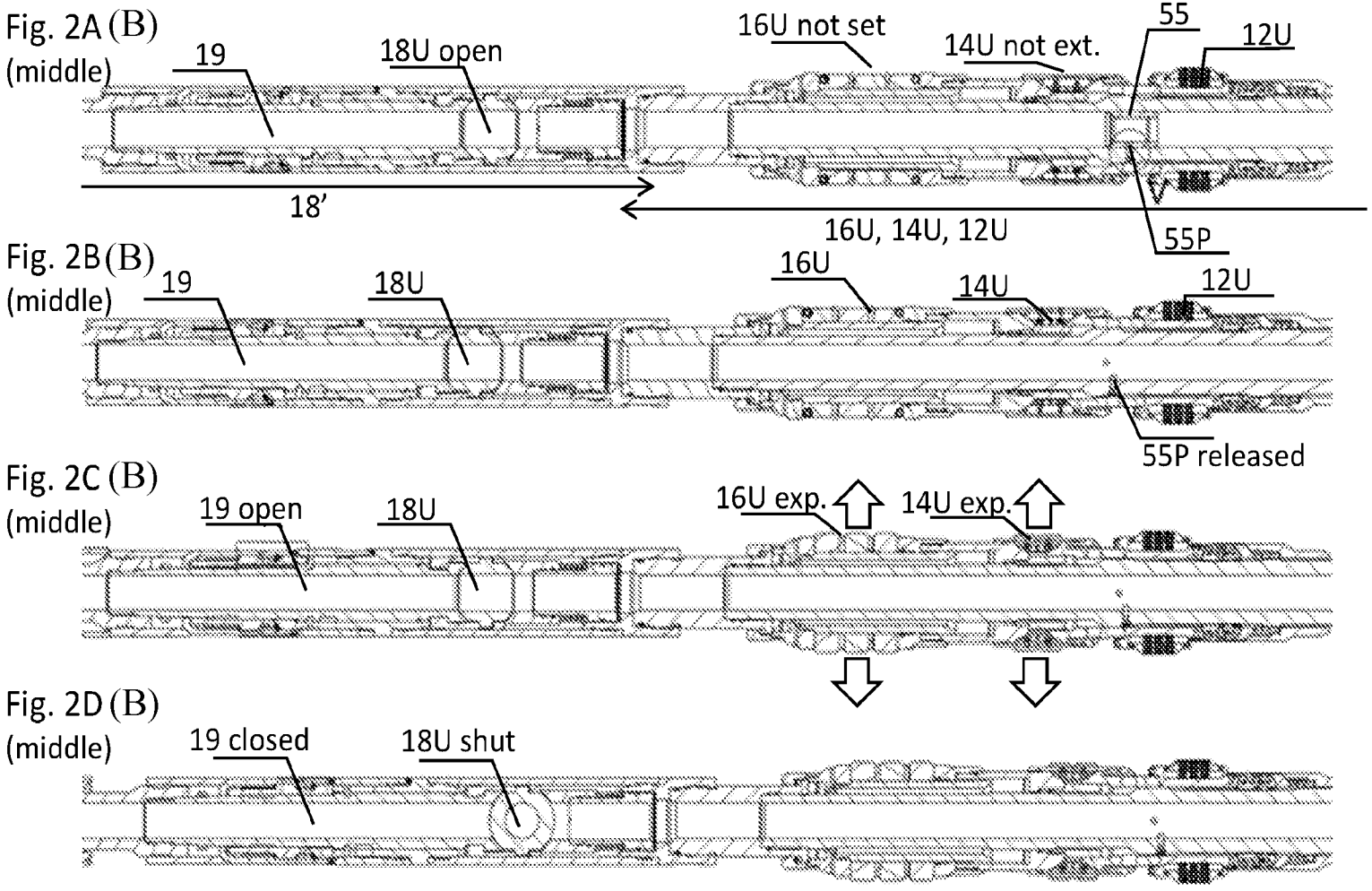
Fig. 2A (B) (middle)
Fig. 2B (B) (middle)
Fig. 2C (B) (middle)
Fig. 2D (B) (middle)

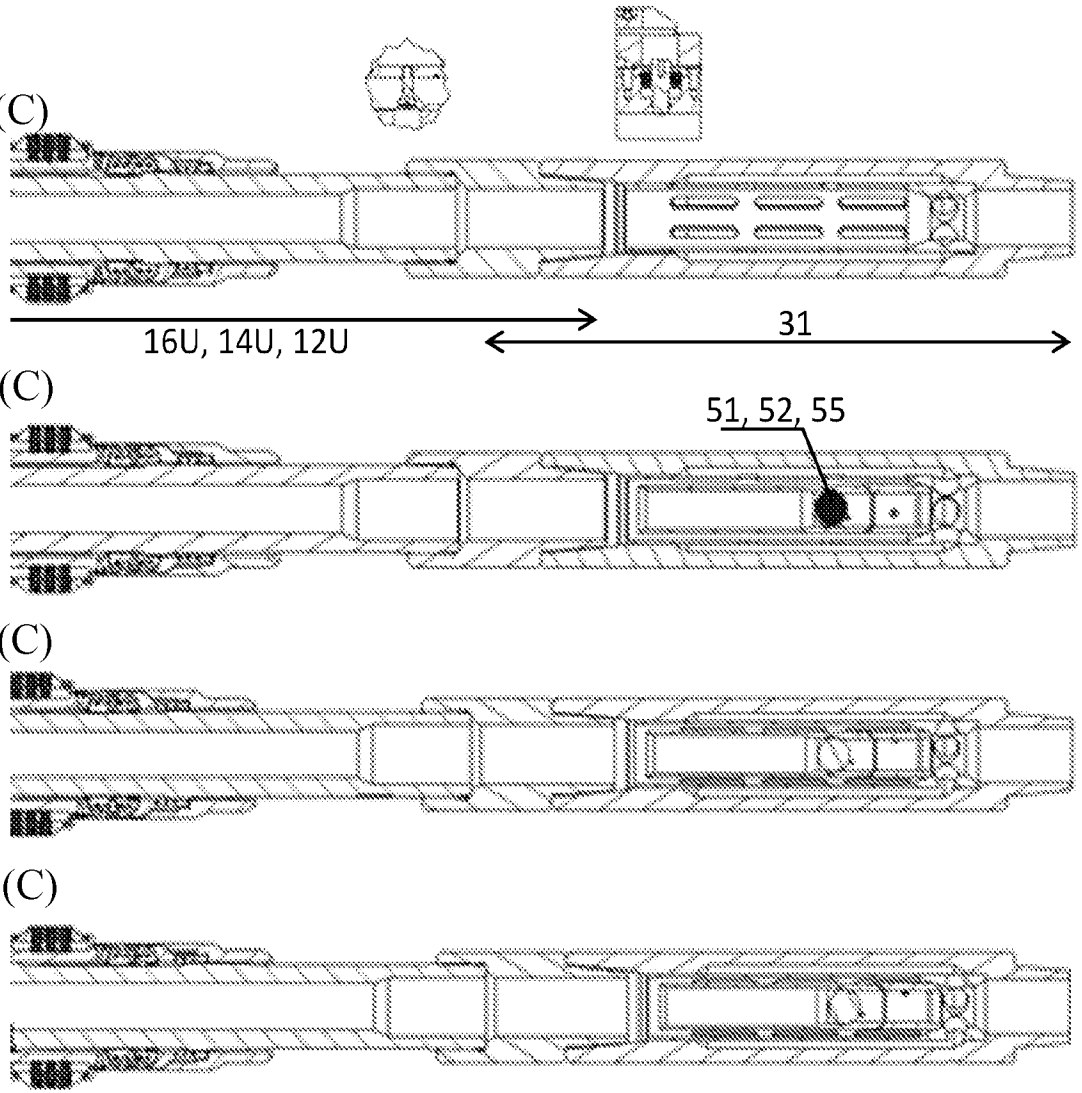
Fig. 2A (C) (right)
Fig. 2B (C) (right)
Fig. 2C (C) (right)
Fig. 2D (C) (right)

TANDEM RELEASABLE BRIDGE PLUG SYSTEM AND METHOD FOR SETTING SUCH TANDEM RELEASABLE BRIDGE PLUGS

FIELD OF THE INVENTION

The present invention is a tandem releasable bridge plug system and a method for setting such tandem releasable bridge plugs in a casing.

BACKGROUND ART

Retrievable bridge plugs or "RBP" are well known in the well service industry. A retrievable bridge plug borne on a drill pipe string may be set by the following actions:

- using drag blocks to set up a rotational resistance,
- rotating the string for setting slips,
- rotating the string for setting a packer,
- pressure testing the packer sealing ability from below by pressurizing the drill pipe string,
- rotating the string for closing a ball valve in the bridge plug,
- rotating the string for disconnecting the drill pipe string from the bridge plug,
- pressure testing the closed bridge plug from above by pressurizing the drill pipe string while the casing valve is closed.

The drill pipe string rotational movements may be to the right or left and corresponding axial movements being up or down may be special designed. The deck crew will know the required steps for a particular connector or "running tool" and perform them sequentially on the deck on the drill pipe string "in blind", by manipulating the drill pipe string topside. Such combinations of rotations and axial forces may be:

- RH rotation and axial downward weight to set the slips, and
- set the packer, (the drag blocks set up a counterforce for against the drill pipe string rotation by their friction against the casing wall)
- subsequent LH rotation to close the ball valve,
- downward force and LH rotation and upward pull to release the connector, and
- pull up to disconnect the drill pipe string connector and remove it from the top of the retrievable bridge plug.

Other rotations and forces may be applicable and is subject to the tool designer's discretion.

An opposite sequence of the opposite steps may be used to retrieve the tool:

- run in hole with the drill pipe sting with the connector,
- down force and RH rotation to reconnect the drill pipe string connector to the top of the retrievable bridge plug,
- (shut the BOP to control possible gas release from below plug)
- subsequent RH rotation to open the ball valve,
- upward force and RH rotation to release the packer, and
- release the slips (remember the drag blocks still set up a counterforce against the drill pipe string rotation by their friction against the casing wall),
- upward force to pull the retrievable bridge plug out of hole.

Such a sequence may be used for releasing an upper plug and running it in to release a lower plug and then retrieving both on a common string. However, as will be explained below, despite such equally designed plugs may be pulled in one run, they may not easily be set in one run due to the manipulations on the drill pipe string will work on the upper plug only, and then the lower plug remains unset.

In the prior art U.S. Pat. No. 9,279,307, two consecutive plugs in a well are removed in one run. The plug of the prior art has no through bore, and a special axially arranged release tool is required below the upper plug, and this is required before setting. However the US patent is not enabled to set two plugs in one run.

In the prior art U.S. Pat. No. 4,928,762 to Mamke, "Retrievable bridge plug and packer", he discloses a retrievable bridge plug and packer apparatus including a packer settable by right-hand rotation and vertical manipulation of the tool string, and a bridge plug also settable by right-hand rotation and vertical manipulation of the tool string. A disabling tool is provided to disable the packer during setting of the bridge plug so that the packer is not prematurely set. After setting of the bridge plug below the formation, the packer and disabling tool may be disengaged from the bridge plug. The disabling tool is disengaged so that the packer may be set above the formation. The packer is unset by pulling the tool string, and the packer and disabling tool may be reconnected to the bridge plug.

U.S. Pat. No. 5,020,597 to Braddick et al., "Arrangement and method for conducting substance and lock therefor" describes a cementing string for a liner, with upper and lower wiper plugs with external seals thereon releasably connected to the operating string. A lock arrangement prevents premature release of the upper and lower wiper by mechanical force, but is responsive to fluid pressure to first release the lower wiper prior to release of the upper wiper.

US patent application 2004/0050546 relates to an arrangement of sequentially configured packer J tools for one trip sequential setting of packer tools and for subsequent one trip sequential release of the tools. The US patent application has been granted U.S. Pat. No. 6,926,088 which discloses a pre-selected set of packer tools having J tools and on/off tools ("stingers" and "washovers") with varying strokes and varying set and release directions to enable the operator to individually address the various packers. By increasing the amount of travel necessary to set and/or release the subsequent packer tools, it is possible to select which tool is being manipulated or operated upon. A packer tool set having at least two selectively disconnectable packer tools for insertion into a wellbore, comprising: a first of said two packer tools having a first J tool including a first J slot for setting said first packer tool; a second of said two packer tools having a second J tool including a second J slot for setting said first packer tool; wherein said first J tool first 3 slot is substantially longer than said second 3 slot of said second J tool such that when said first and second packer tools are connected, lifting said packer tool set a predetermined distance releases said first packer tool, but does not release said second packer tool.

U.S. Pat. No. 2,806,532 provides an improved method and apparatus for straddling casing perforations and for applying high pressures safely to the locations surrounding the casing perforations.

U.S. Pat. No. 4,794,989 discloses an apparatus for use in completing oil or gas wells having two or more perforated production zones which includes packers and assemblies for closing off the annular space between the tubing string and the well bore intermediate adjacent zones to isolate one from the other in order to produce from each individually.

US patent application 2004/0251024 describes a method for performing single trip perforation and packing operations via a downhole assembly in a cased well bor. The assembly is provided with an upper packer and a lower packer and has fluid communication established therethrough. The upper packer of the assembly is set to isolate a perforated production zone by introducing pressurized fluid through the assembly and against the casing below the lower packer of the assembly.

A first problem in the industry, since the lower plug is set by manipulating the drill pipe string through rotational left or right, and/or axial movements up or down, and if combining two similarly operated plugs, one may hardly control upon manipulating the drill pipe string rotationally and axially, which plug does what. One solution may be to design the plugs with mutually excluding different setting and releasing mechanisms but this requires much special preparation of each tool and a large stock of tools with separate setting and release mechanisms. The result, in practice, is that one may only set one plug on one drill pipe string at a time, requiring a second run for setting the second plug. So setting the plug may take twice the time compared to removing them. Further, setting two plugs in an emergency is not possible with the prior art.

A second problem in the industry is, since it is only possible to set one plug in one run, one may only have the time required to set one plug in a safety disconnect plugging operation such as for disconnecting the upper part of the drill pipe string and hanging off the major part of the drill string in one plug in the borehole.

A third problem is that in order to use two plugs for search and location of a casing string leakage, one may run a lower plug on a first drill pipe string and then locate the lower bound of the leak, then run an upper plug on a second drill pipe string to locate the upper bound of the leak, and thus locate the location of the leak. Such a leak may be in a casing string of continuous even diameter, or it may be in a transition from one casing diameter to a liner diameter, i.e. for testing a liner hanger seal.

SHORT SUMMARY OF THE INVENTION

A main object of the present invention is to disclose a tandem releasable bridge plug system and a method for setting such tandem releasable bridge plugs. The method for setting the releasable bridge plugs is defined as follows: a method of setting a tandem releasable bridge plug system in a casing (0), comprising the steps of:

assembling a tandem bridge plug string (1L,1U) comprising from bottom to top:

a lower bridge plug (1L) on a lower, disconnectable connector (2L), an upper bridge plug (1U) on an upper, disconnectable connector (2U) said upper bridge plug (1U) and said upper disconnectable connector (2U) initially disabled by a lock (5) and unlockable from topsides, wherein disabling the upper bridge plug (1U) is initially made by a ball seat axial sleeve (52) arranged in a collet sleeve (53) constituting the lock (5), of the connector (2U), the ball seat axial sleeve (52) is releasable by a drop ball (51) to allow the collet sleeve (53) be forced upwardly and unlock the lock (5) enabling the upper connector (2U) to be axially and rotationally operable relative to the upper bridge plug (1U) by the drill pipe string (4), and running in the tandem plug string (1L,1U) on a drill pipe string (4) until the lower plug (1L) is at its setting target depth (dL) in the casing (0);

setting the lower plug ((1L); setting a packer (16) of the lower plug (1L); pressure integrity testing the sealing effect of the lower plug's (1L) packer (16L) from below by pressurizing the drill pipe string (4) topsides, and shutting the lower plug (1L);

disconnecting the upper plug (1U) from the lower plug (1L);

pulling up the upper plug (1U) to its upper setting target depth (dU) in the casing (0), enabling the upper plug (1U) by releasing the lock (5);

setting the upper plug (1U) setting a packer (16U) of the upper plug (1U); pressure integrity testing the sealing effect of the upper plug's (1U) packer (16U) from below by pressurizing the drill pipe string (4) topsides, and shutting the upper plug (1U);

disconnecting the drill pipe string (4) from the upper plug (1U).

The plug system used in the above method is a tandem releasable bridge plug system arranged for setting a in a casing (0), with a tandem bridge plug string (1L,1U) comprising from bottom to top:

a lower bridge plug (1L) on a lower, disconnectable connector (2L)

and an upper bridge plug (1U) on an upper, disconnectable connector (2U), said tandem bridge plug string (1L, 1U) characterized in that said upper bridge plug (1U) on and said upper, disconnectable connector (2U) both are arranged for being initially disabled by a lock (5) and unlockable from topsides, said lock (5) comprising a ball seat axial sleeve (52) arranged in a collet sleeve (53), the ball seat axial sleeve (52) being releasable by a drop ball (51) to allow the collet sleeve (53) be forced upwardly and unlock the lock (5) enabling the upper connector (2U) to be axially and rotationally operable relative to the upper bridge plug (1U) by the drill pipe string (4), and said tandem bridge plug string (1L,1U) arranged for being run in on a drill pipe string (4) with said lower plug (1L) to a setting target depth (dL) in said casing (0);

said lower plug (1L) arranged for being set in said casing (0), a lower packer (16L) of said lower plug (1L) for being set in said casing (0), said lower plug (1L) having a through central bore (19) with a lower ball valve (18L) so as for allowing arranged for pressure integrity testing of said lower packer's (16L) sealing effect from below by pressurizing said drill pipe string (4) topsides, and closing said lower ball valve (18L) plug (1L) arranged for being thus shutting said lower plug (1L), said lower connector (2L) arranged for disconnecting said lower plug (1L) from said upper plug (1U);

said upper plug (1U) arranged for being pulled up to an upper setting target depth (dU) in said casing (0), said upper plug (1U) arranged for being enabled by releasing said lock (5);

said upper plug (1U) having an upper packer (16U), said upper packer (16U) arranged for being set, said upper plug (1U) having a through central bore (19), with an upper ball valve (18U) so as for allowing pressure integrity testing of the upper packer's (16U) sealing effect from below by pressurizing the drill pipe string (4) topsides, said upper plug (1U) arranged for being shut by closing said upper ball valve (18U);

said upper connector (2U) arranged for disconnecting said upper plug (1U) arranged for being disconnected from said drill pipe string (4) above it.

The first problem of setting two plugs in one run is thus solved by the invention. This reduces the setting time for two plugs by about 50%. Time is costly both from an economical and a safety view; a drilling rig and particularly a marine drilling platform has high day rates. Time may costly from a safety point of view if the two plugs are to set fast in order to remedy an undesired state of the well. The invention has several further significant advantages.

The second problem of not being able to set two plugs during a safety disconnect operation is solved by the invention. First, if the lower plug is set with the hang-off drill string below, then the most imperative problem is solved, the well is plugged by one plug, and one may leave the well in an emergency. If time allows, one may quickly set the upper plug as a backup to reduce the risk of blow out, and then disconnect and prepare to leave the well.

The third problem of not being able to conduct a single run pressure testing for leak location in a casing string is solved.

FIGURE CAPTIONS

The attached figures illustrate some embodiments of the claimed invention.

FIG. 1A-1I illustrates embodiments of invention's method; the steps of setting two plugs in a cased well.

FIG. 1A shows run in hole for the assembled upper plug (1U) and lower plug (1L) until the latter is at its lower target depth (dL). In an embodiment both plugs are through-bore and initially their main bore valves are open.

FIG. 1B illustrates that weight and right hand (RH) rotation is exerted on the drill pipe string from topside, the lower plug is then set, but not necessarily closed. "Set" here may imply setting the slips and setting the expandable packer. Optionally pressure P may be set on the drill pipe string from topside to test the still open lower plug (1L) from below pressure.

FIG. 1C illustrates left hand (LH) rotation to close the valve of the lower plug (1L).

FIG. 1D shows a further step of combined push and subsequent left-hand rotation (LH) combined with pull on the drill pipe string (4) to release the lower connector (2L) from the top of the lower plug. (Please also see FIG. 4). FIG. 1D shows pulling the upper plug (1U) to its target depth (dU). Now with the lower plug closed and the intermediate drill pipe string (3) open at its lower end (with the through bore connector (2L) open) one may optionally set pressure P on the drill pipe string from topside to test the now shut lower plug (1L) from above pressure. The above procedure is usually satisfactory on the first run, but if the pressure tests are not satisfactory it is still possible to open, release and reposition the lower plug (1L), and test again, because the upper plug (1U) is still un-enabled; it only works in principle as any drill pipe string section as part of the drill pipe string (4) and intermediate drill pipe string (3) all extending from topside. (except for its dragging drag blocks).

Figure 1A:
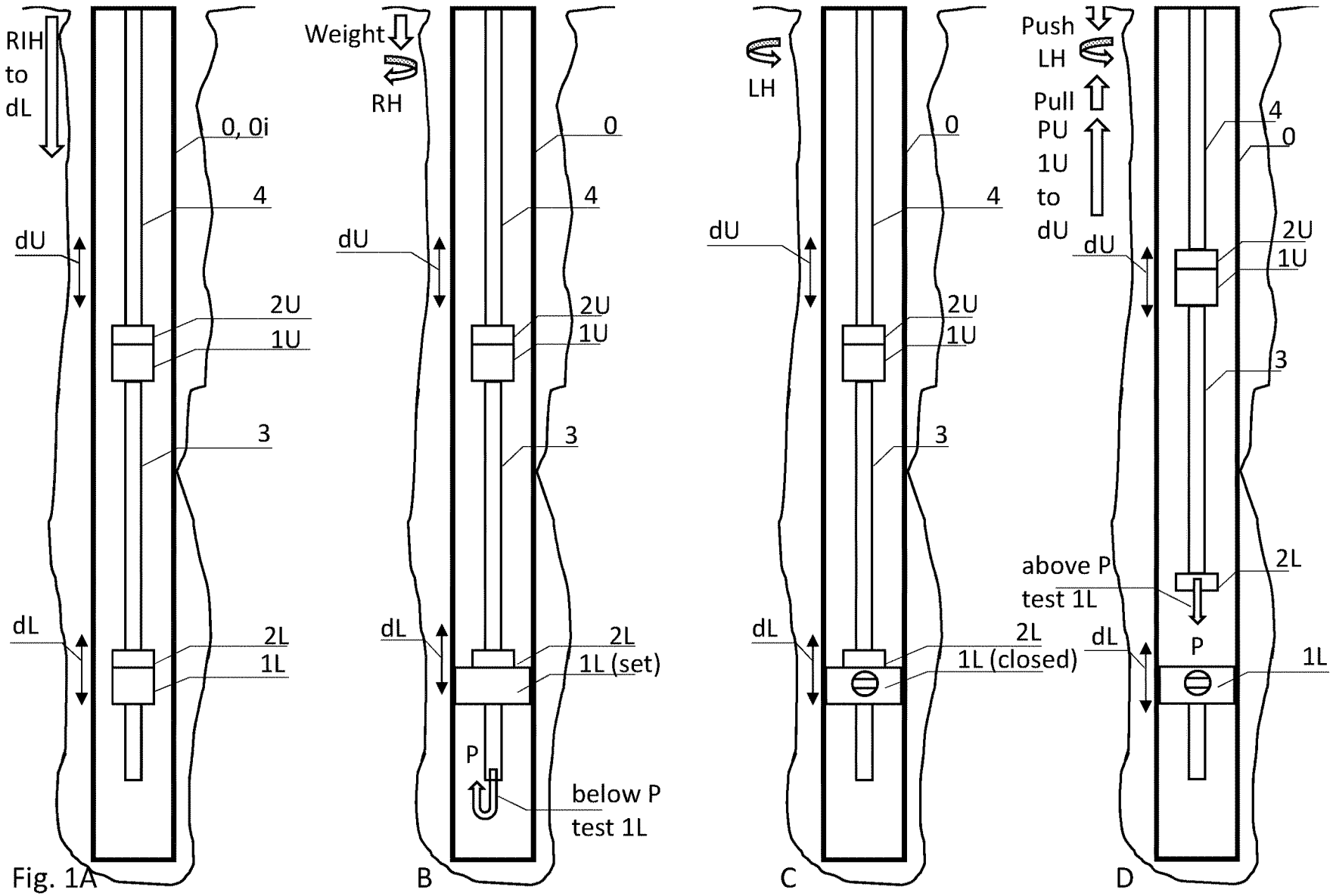
Figure 1E:
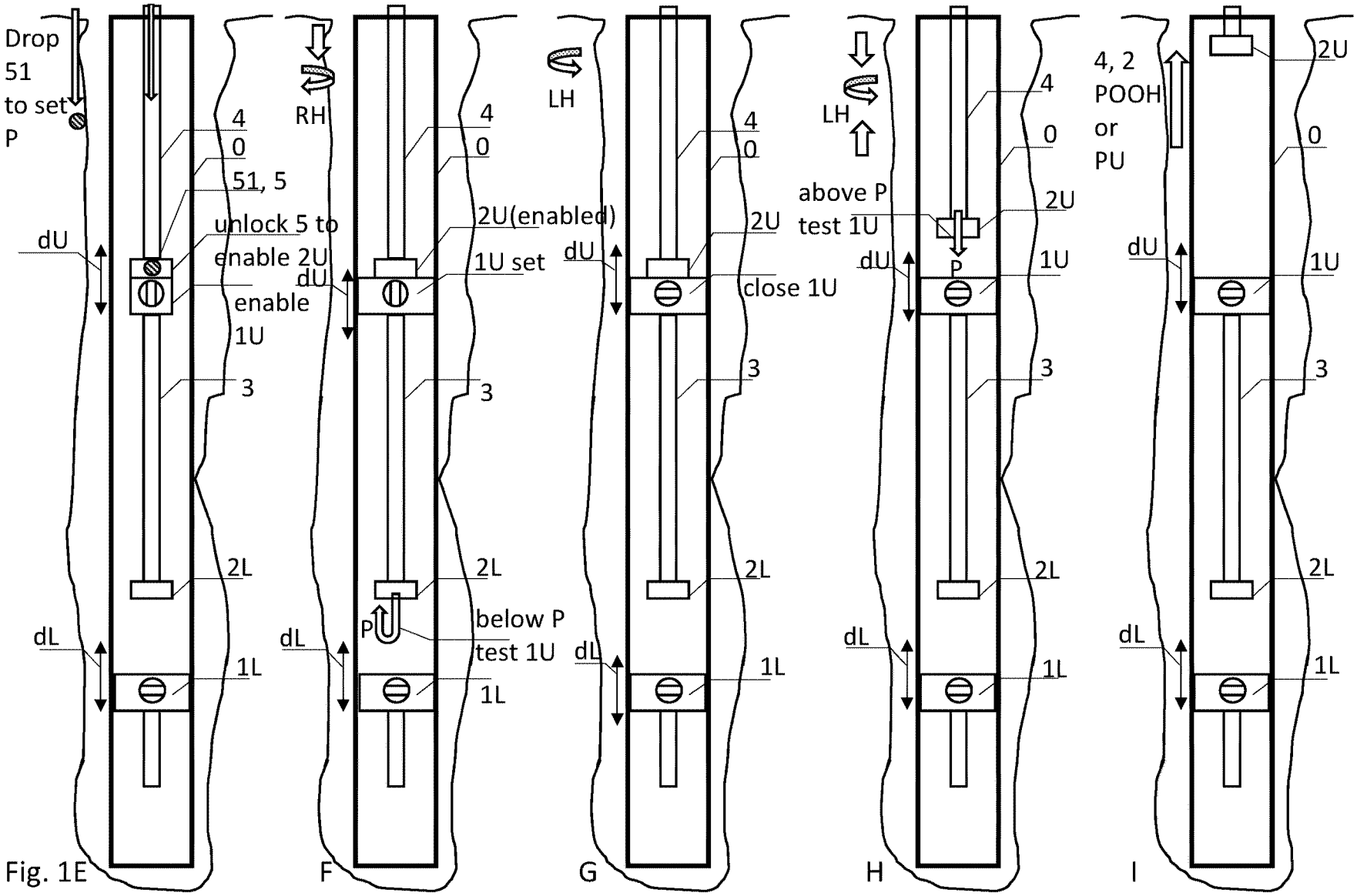

FIG. 1E illustrates a subsequent key step of the invention wherein a ball or dart is dropped to unlock and enable the upper plug (1U), i.e. in an embodiment of the invention, in practice, it unlocks the upper connector (2U) and the upper plug (1U) so as for enabling them to make the rotational and axial movements required to set and close the upper plug (1U) and to disconnect the upper plug (1U); please see the subsequent series of illustrated steps. From now on, the upper plug (1U) is operable from topside and in an embodiment it may be of the same type as the lower plug (1L), albeit not necessarily of the same dimension.

FIG. 1F shows setting the now enabled upper plug (1U), preferably by setting its slips and its expandable packer, both by weight down and right hand rotation, and an optional step of pressure testing the set packer of the upper plug (1U) from below.

FIG. 1G illustrates a subsequent step of closing the upper plug (1U) by left-hand (LH) rotation. Please notice that because one has disconnected the upper plug (1U) from the lower plug (1L), any rotational an axial movements for operating the upper plug (1U) does not affect the lower plug (1L) which is set, simply.

FIG. 1H illustrates a next step of pulling upward and left hand rotation (LH) in order to disconnect the upper connector (2U) from the upper plug (1U). Optionally one may now pressure test from above. It is now possible to reconnect, open, release, and reposition the upper plug (1U) if the pressure test is not satisfactory.

FIG. 1I shows that the two plugs are now set in their target depths and from the topside one may pull up (PU) or pull out of hole (POOH) with the drill pipe string (4) and the upper connector (2U).

FIG. 2A to D illustrates an embodiment of the upper plug (1U) in a longitudinal section, the proximal end to the left.

FIG. 2A shows a run in hole state the longitudinal section of the upper plug (1U) with the disconnectable connector (2U) to the left, having a lock unit (5) for temporarily inactivating the connector (2U); a ball valve section (18'); a packer and slip section (16U, 14U) with drag blocks (12U). A ball (51) is shown being dropped and about to land in the ball seat of the ball seat axial sleeve (52), thus enabling the collet sleeve (53), which has inward yielding collet splines, to be moveable under axial force within the upper connector sleeve (2U) when released. The ball valve (18U) is not closed. The through central bore (19) of the tool is open. The slips (14U) are not extended. The packer (16U) is not set. The drag blocks (12U) are extended and will drag on the casing wall.

FIG. 2B shows the ball (51) having released the ball seat axial sleeve (52) which has passed through the tool (1U) and has sheared out and released the second shear seat (55) which so far had held the anti-rotation pins (55P) which disable independent core rotation of the setting mechanism for the RH rotation of the slips (14) and the compression of the packer (16). Please see the ball (51), the ball seat axial sleeve (52) and the second shear seat (55) now caught in the ball catcher.

FIG. 2C illustrates the further step of setting the plug and unlocking the ball valve by screw-compressing the packer and slip section (14U, 16U), the stem no longer held by the anti-rotation pins (55P) and the barrel held by the drag blocks, to extend the slips (14U) and set the packer (16U). The collet sleeve (53) is pushed in by stinger (2U1).

FIG. 2D shows the further step wherein the plug has been set and the ball valve is closed, comprising shutting the ball valve (18U), thus closing the central bore (19).

Figure 3A:
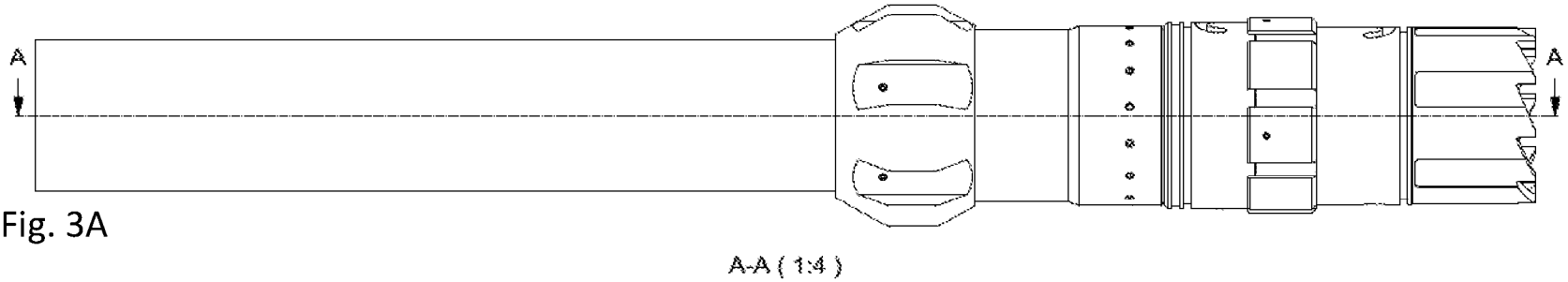

FIG. 3A is a lateral view of the upper connector sleeve (2U).

Figure 3B:
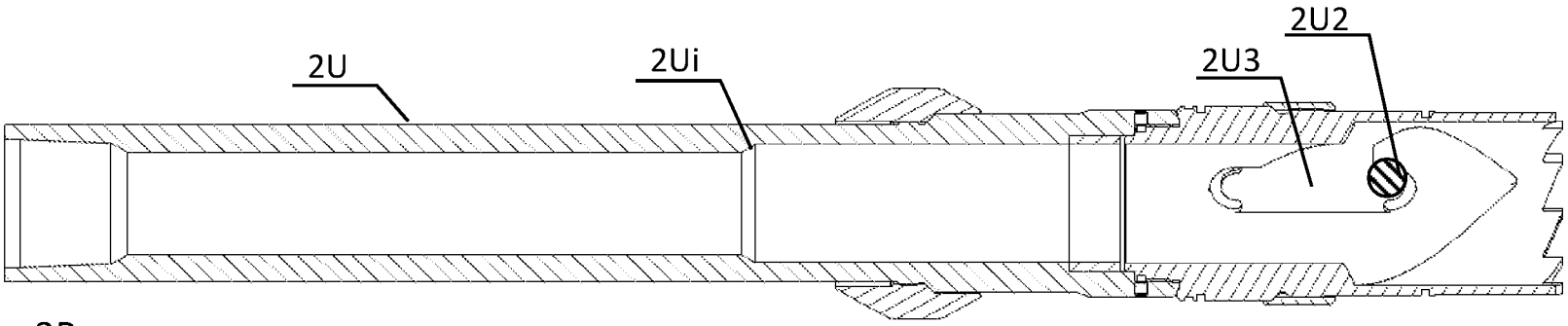

FIG. 3B is a longitudinal section view of the upper connector sleeve (2U), i.e. the sleeve portion of the connector (2U) which shall combine with the upper plug's (1U) top stinger portion (2U1). Please see FIG. 2A, 2B, 2C for their operations in sequence. In the central bore (19) of the connector sleeve (2U) there is arranged a collet sleeve (53) temporarily blocked by lock unit (5) for temporarily inactivating the connector (2U), which is enabled by dropping a ball (51). Please see below for ball seat lock details. Further FIG. 3B depicts an internal shoulder (2Ui) for knobs on inward yielding collet sleeve (53) to be held back before sheared out seat (52) is removed. Upper connector (2U) has J-slots (2U3) for dogs (2U2) on the upper stinger (2U1). The J-slots are arranged for push and left hand rotation of the drill string to release.

Figure 4:
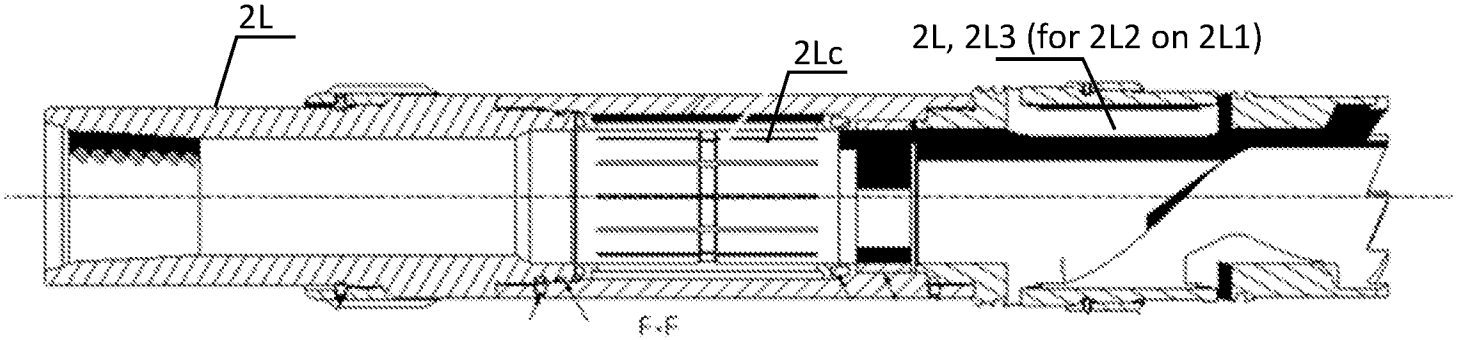

FIG. 4 shows the lower connector sleeve (2L) in a longitudinal section view. It shows an embodiment of the invention wherein the lower connector (2L) is arranged for being subject to weight, then a lower connector collet (2Lc) collapses by yielding outwardly and allows that the running and retrieval tool (the lower connector 2L) with its internal 3-slots may be pushed downward on its stinger portion (2L1) with radial dogs (2L2), so as for the radial dogs to be guided upwardly in the 3-slot (2L3), then we rotate to the left (LH) and pull up. Now the lower connector (2L) is free from the lower plug's (1L) stinger portion (2L1) at its top.

THE INVENTION AND EMBODIMENTS OF THE INVENTION

The invention will in the following be described and embodiments of the invention will be explained with reference to the accompanying drawings.

Main Invention:

The invention is a method of setting a tandem releasable bridge plug system in a casing (0). The method comprises, in its minimum, broadest definition, the steps of:

- assembling a tandem bridge plug string (1L,1U) comprising from bottom to top the following elements:
  - a lower bridge plug (1L) on a lower disconnectable connector (2L),
  - an upper bridge plug (1U) on an upper disconnectable connector (2U) who both are initially disabled by a lock (5) and unlockable from topsides.
- running in the tandem plug string (1L,1U) on a drill pipe string (4) until the lower plug (1L) is at its setting target depth (dL) in the casing (0), please see FIG. 1,
- setting and shutting the lower plug (1L),
- disconnecting the upper plug (1U) from the lower plug (1L),
- pulling up the upper plug (1U) to its upper setting target depth (dU) in the casing (0),
- enabling the upper connector and the upper plug (1U) by releasing the lock (5);
- setting and shutting the upper plug (1U);
- disconnecting the drill pipe string (4) from the upper plug (1U).

After the above steps one may pull out the drill pipe string (4) from the well, depending on the subsequent operation to be made on the well.

The disconnectable connectors (2U, 2L) are both usually named "running and retrieving tool" of which an upper half, the upper sleeve portions, please see FIG. 4 belongs to the lower end of a running drill pipe string, here the drill pipe string (4) and the intermediate drill pipe string (3), and the corresponding lower half, a stinger portion (2U1, 2L1) with dogs for fitting into corresponding J-slots (2U3, 2L3) respectively, which belong to the upper retrievable bridge plug (1U) and the lower retrievable plug (1L), respectively. For the lower disconnectable connector (2L) please see FIG. 2A in its initial, locked and non-enabled state.

Standard Lower Bridge Plug:

The lower bridge plug is set according to the above described steps under the background art. The big issue is how to set the lower bridge plug (1L) without setting or releasing the similarly operated upper bridge plug (1U), then release the upper bridge plug (1U) from the lower bridge plug (1L), and first now enabling the mechanism for initiating and conducting setting and release of the upper bridge plug (1U). In this way the tandem plugs (1L, 1U) may be set on one and the same run.

Lower Plug Repositioning Possible:

Before the upper plug (1U) is enabled, the lower plug (1L) may be repositioned until its operational required slip holding force and sealing property is met. After the upper plug (1U) is enabled, the lower plug (1L) may thereafter in practice only be released and retrieved, preferably together with the upper plug (1U). We therefore do not show the release sequence because it is understandable as an inverse sequence when the setting sequence herein is explained.

Initially Disabled Upper Plug:

The initially disabled upper bridge plug (1U) and its disconnectable connector (2U) are initially, before and during run-in and setting of the lower bridge plug (1L), temporarily disabled from being settable by any rotational and axial movements by the lock (5). In effect, except for the drag blocks (12) of the upper bridge plug (1U), it just forms another passive part of the drill pipe string (4) as seen from the lower bridge plug. Thus the deck crew may control the lower bridge plug (1U) as if it were the only bridge plug on the drill pipe string (4).

Ball Seat Lock Details:

In an embodiment of the invention, the initial disabling of the upper bridge plug (1U) is made by a ball seat axial sleeve (52) arranged in a collet sleeve (53) constituting the lock (5) of the connector (2U), please see FIG. 3*a*. The ball seat axial sleeve (52) prevents the collets of the collet sleeve (53), because they may only yield inwardly, thus hanging on a rim shoulder. The ball seat axial sleeve (52) is releasable by a drop ball (51) to allow the stinger (2U1)—mounted collet sleeve (53), preferably with external dogs on collet sleeves, be forced upwardly to unlock the lock (5), thereby enabling the release tool (2U) to be collapsed on its corresponding stinger portion (2U1) which is mounted on top of the upper plug (1U), please also see FIG. 3*b*. The force required to move the collet sleeve (53) when enabled, is in an embodiment 6½ to 7½ MT (metric tonnes) weight exerted by the drill pipe string (4), while other values may be selected by another mechanical designer skilled in the art.

Ball Catcher:

In an embodiment of the invention the ball (51) and the ball seat axial sleeve, hereafter called the first ball sleeve (52), may be transported by the pressure through the central bore and be caught in a ball catcher (31) at the lower end of the upper retrievable bridge plug (1U). It is undesirable that the ball and sleeve shall drop freely into the casing below the upper plug (1U) as it could interfere with the lower plug (1L) on attempting reconnecting for retrieval and also create other problems. The relative shear pressure of the first seat sleeve (52) is in an embodiment set to 69 Bar (1000 psi).

When the release tool section (2U) is enabled to collapse and be extended, an upper plug (1U) initiation and setting sequence may be activated.

Second "Ball" Shear Seat, Anti-Rotation Pins:

In an embodiment of the invention the released down going seat sleeve (52) will bring along with it a second seat sleeve (55), please see between the drag block unit and the slip unit (14) in FIG. 1*a*, the second seat sleeve (55) hitherto disabling the rotational movement for engaging the slips (14) and the packer (16). This second seat sleeve (55) has shear pins requiring a lower pressure to release than the first seat sleeve (52), so if the first sleeve is sheared, one will be sure that the second sleeve is also sheared immediately after. The second seat sleeve (55) releases upon its removal oppositely directed spring loaded anti-rotation pins (55P)

outwardly, so as for allowing free rotation of the core stem relative to the surrounding sleeve-shaped stem, thus enabling the rotational movement for the slip and packer activation to start. The relative pressure required for the second seat sleeve (55) is 54 Bar (780 psi) in an embodiment. Other shear pressures for both seat sleeves are selectable according to the discretion of a tool designer.

In an embodiment of the invention, after enabling the release tool (2U), it is enabled for collapsing the release tool (2U), please see FIG. 1*b*, to operate on and rotate the drill pipe string (4) relative to the drag blocks (12U) of the upper plug (1U) to engage its slips (14) with the casing (0) and subsequently engaging the packer (16) to seal against the casing (0), please see also FIG. 1*c* and FIG. 1*d*.

Intermediate Drill Pipe String:

In the above, the lower and upper plugs (2L, 2U) are connected and are separated by any distance, at minimum only separated by the lower connector (2L). In an embodiment of the invention, it is advantageous to use an intermediate drill pipe string (3) below the upper plug (1U) and the lower connector (2L) on the lower plug (1L). The length of the intermediate drill pipe string (3) should only be limited to an embodiment of the invention wherein it corresponds to have a length slightly less than the distance between the lower target depth (dL) for the lower plug (1L) and the upper target depth (dU) for the upper plug (2U). This in order for allowing disconnecting from the lower plug (1L) before placing and setting the upper plug (1U). If they were still mechanically connected one could not rotate and move the upper drill pipe string (4) from topsides without affecting the lower plug (1L). A significant advantage of having an intermediate string (3) length of almost the depth difference between lower and upper target depths (dL, dU) becomes evident if the target depth difference is large: Given a lower target depth (dL) of, say 5000 m, and upper target depth (dU) of 1000 m, one would then have to run in lower plug (1L), then 4000 m of intermediate string (3), then upper plug (1U), and 1000 m of drill pipe string (4), in order to reach lower target depth. It would then be an operational advantage that when lower plug (1L) is set, the lower disconnectable connector (2L) is released, then the upper plug (1U) is near below its upper target depth (dU) and is rapidly set upon pulling out a short distance, and then after testing one may pull out the relatively short, here 1000 m of drill pipe string (4) only. Thus the two purely setting operations are conducted consecutively. Those are embodiments of the invention and may be varied with respect to relative lengths.

Free Upper Plug:

In an embodiment of the invention, the upper plug (1U) with its below mounted intermediate drill pipe string (3) is released from the lower plug (1L), and the upper plug (1U) may be enabled, not earlier. After the upper plug is enabled and also free from the lower plug (1L), and any drill pipe string manipulation with rotation or axial movement, will not affect the lower plug. The upper plug may now be set and pressure tested, and if necessary, released and repositioned for further testing until satisfactory, and then disconnected.

Ball Catcher:

In an embodiment of the invention, there is arranged a ball and seat catcher (31) below the upper plug (1U) and above the lower connector (2L).

Testing Lower Plug from Below:

In an embodiment of the invention, after setting and before shutting the lower plug (1U), setting its packer (16), and then conduct pressure integrity testing the sealing effect of the lower plug's (1L) packer (16) from below by pressurizing the drill pipe string (4) topsides.

Testing Lower Plug from Above:

In a further embodiment of the above, after shutting the lower plug (1L) and disconnecting from the lower plug, conducting pressure integrity testing the lower plug (1L) from above.

Testing Upper Plug from Below:

In an embodiment of the invention, one may test the upper plug from below by after setting, before shutting the upper plug (1U), setting its packer (16), and then conduct pressure integrity testing for verifying the sealing effect of the upper plug's (1U) packer (16) from the casing space below but above the lower plug (1L) by pressurizing the drill pipe string (4) topsides.

Testing Upper Plug from Above:

Similar to above, in a further embodiment of the invention, one may test the pressure integrity of the upper plug from above by, after shutting the upper plug (1U) and disconnecting the drill pipe string (4), pressure integrity testing the upper plug (1U) from above.

If the casing to be plugged is of even diameter the upper and lower plugs (1U, 1L) are of the same diameter. In an embodiment the lower plug (1L) may be of a lower diameter than the upper plug (1U), e.g. if the lower plug (1L) shall be set in a liner below a liner hanger in a casing.

The invention claimed is:

1. A method of setting a tandem releasable bridge plug system in a casing, comprising the steps of:

assembling a tandem bridge plug string comprising from bottom to top:

a lower bridge plug on a lower, disconnectable connector;

an upper bridge plug on an upper, disconnectable connector, said upper bridge plug and upper disconnectable connector initially disabled by a lock and unlockable from topsides, wherein disabling the upper bridge plug is initially made by a ball seat axial sleeve arranged in a collet sleeve constituting the lock of the connector, the ball seat axial sleeve being releasable by a drop ball to allow the collet sleeve to be forced upwardly and unlock the lock enabling the upper connector to be axially and rotationally operable relative to the upper bridge plug by a drill pipe string;

running in the tandem plug string on the drill pipe string until the lower bridge plug is at a setting target depth thereof in the casing;

setting the lower bridge plug;

setting a packer of the lower bridge plug;

pressure integrity testing the sealing effect of said packer of the lower bridge plug from below by pressurizing the drill pipe string topsides, and shutting the lower bridge plug;

disconnecting the upper bridge plug from the lower bridge plug;

pulling up the upper bridge plug to an upper setting target depth thereof in the casing;

enabling the upper bridge plug by releasing the lock;

setting the upper bridge plug;

setting a packer of the upper bridge plug;

pressure integrity testing the sealing effect of the packer of the upper bridge plug from below by pressurizing the drill pipe string topsides, and shutting the upper bridge plug; and disconnecting the drill pipe string from the upper bridge plug.

2. The method of claim 1, wherein said releasable ball seat sleeve is arranged for, after having been released by said drop ball, passing through said upper bridge plug and shearing out and releasing a second shear seat and bringing along with the second shear sheet a second shear seat sleeve down to a ball catcher, said second shear seat initially holding anti-rotation pins disabling the rotational movement of the drill pipe string to engage upper slips and said upper packer, wherein after enabling the upper connector and the upper bridge plug, using the upper connector to operate on said upper bridge plug and rotating the drill pipe string relative to drag blocks of said upper bridge plug to engage said upper slips with the casing and subsequently engaging said upper packer to seal against said casing.

3. The method of claim 2, the step of setting the upper bridge plug comprising, after dropping said ball through the drill pipe string to enable axial and rotational movement of said upper connector, while allowing said upper set of drag blocks to drag on an inner wall of said casing, manipulating said drill pipe string topsides using right hand rotation and axial weight for activating of said upper set of slips to engage and hold on the inner wall of said casing, and activating of said upper packer to seal against the inner wall of said casing.

4. The method claim 3, further comprising, after dropping said ball, setting said drag blocks, activating said upper set of slips and setting said upper packer, and using left hand rotation for activating an upper ball valve to shut for closing a central bore of said upper bridge plug.

5. The method of claim 2, further comprising using an intermediate drill pipe string below the upper bridge plug and above the lower connector on the lower bridge plug.

6. The method of claim 2, further comprising using a ball and seat catcher below the upper bridge plug and above the lower connector.

7. The method of claim 2, wherein the step of setting the lower bridge plug comprises, while allowing a lower set of drag blocks of said lower bridge plug to drag on an inner wall of said casing, activating a lower set of slips of said lower bridge plug to engage and hold on the inner wall of said casing, said method further comprising, after testing said lower bridge plug for pressure integrity from below, shutting said lower bridge plug by closing a lower ball valve to shut a central bore of said lower bridge plug.

8. The method of claim 1, further comprising using an intermediate drill pipe string below the upper bridge plug and above the lower connector on the lower bridge plug.

9. The method of claim 8, further comprising using a ball and seat catcher below the upper bridge plug and above the lower connector.

10. The method of claim 8, wherein the step of setting the lower bridge plug comprises, while allowing a lower set of drag blocks of said lower bridge plug to drag on an inner wall of said casing, activating a lower set of slips of said lower bridge plug to engage and hold on the inner wall of said casing, said method further comprising, after testing said lower bridge plug for pressure integrity from below, shutting said lower bridge plug by closing a lower ball valve to shut a central bore of said lower bridge plug.

11. The method of claim 1, further comprising using a ball and seat catcher below the upper bridge plug and above the lower connector.

12. The method of claim 11, wherein the step of setting the lower bridge plug comprises, while allowing a lower set of drag blocks of said lower bridge plug to drag on an inner wall of said casing, activating a lower set of slips of said lower bridge plug to engage and hold on the inner wall of said casing, said method further comprising, after testing said lower bridge plug for pressure integrity from below, shutting said lower bridge plug by closing a lower ball valve to shut a central bore of said lower bridge plug.

13. The method of claim 1, further comprising, after shutting the lower bridge plug and disconnecting from the lower bridge plug, pressure integrity testing the lower bridge plug from above.

14. The method of claim 13, wherein the step of setting the lower bridge plug comprises, while allowing a lower set of drag blocks of said lower bridge plug to drag on an inner wall of said casing, activating a lower set of slips of said lower bridge plug to engage and hold on the inner wall of said casing, said method further comprising, after testing said lower bridge plug for pressure integrity from below, shutting said lower bridge plug by closing a lower ball valve to shut a central bore of said lower bridge plug.

15. The method of claim 1, further comprising, after shutting the upper bridge plug and disconnecting the drill pipe string, pressure integrity testing the upper bridge plug from above.

16. The method of claim 1, wherein the step of setting the lower bridge plug comprises, while allowing a lower set of drag blocks of said lower bridge plug to drag on said casing's inner wall, activating a lower set of slips of said lower bridge plug to engage and hold on an inner wall of said casing, said method further comprising, after testing said lower bridge plug for pressure integrity from below, shutting said lower bridge plug by closing a lower ball valve to shut a central bore of said lower bridge plug.

17. The method of claim 16, the setting of said lower bridge plug comprising, while allowing said lower set of drag blocks of said lower bridge plug to hold on the inner wall of said casing, using right hand rotation and axial weight for activating said lower set of slips to engage and hold on said casing inner wall, and for activating said lower packer to seal against the inner wall of said casing.

18. The method of claim 17, further comprising, after engaging said slips and setting said lower packer, using left hand rotation for activating a lower ball valve to shut.

19. The method of claim 1, wherein the step of setting said upper bridge plug comprises, while allowing an upper set of drag blocks of said upper bridge plug to drag on an inner wall of said casing, activating an upper set of slips of said upper bridge plug to engage and hold on said casing's inner wall, said method further comprising, after testing said upper bridge plug for pressure integrity from below, shutting said upper bridge plug by closing an upper ball valve in said upper bridge plug to shut a central bore of said upper bridge plug.

20. A tandem releasable bridge plug system arranged for setting in a casing, with a tandem bridge plug string comprising from bottom to top:

a lower bridge plug on a lower, disconnectable connector and an upper bridge plug on an upper, disconnectable connector, said tandem bridge plug string wherein:

said upper bridge plug and said upper, disconnectable connector are arranged for being initially disabled by a lock and unlockable from topsides, said lock comprising a ball seat axial sleeve arranged in a collet sleeve, the ball seat axial sleeve being releasable by a drop ball to allow the collet sleeve to be forced upwardly and unlock the lock enabling the upper connector to be axially and rotationally operable relative to the upper bridge plug by a drill pipe string;

said tandem bridge plug string arranged for being run in on the drill pipe string with said lower bridge plug to a setting target depth in said casing;

said lower bridge plug is arranged for being set in said casing, a lower packer of said lower bridge plug for being set in said casing, said lower bridge plug having a through central bore with a lower ball valve so as for allowing pressure integrity testing of a sealing effect of said lower packer from below by pressurizing said drill pipe string topsides, and closing said lower ball valve thus shutting said lower bridge plug;

said lower connector is arranged for disconnecting said lower bridge plug from said upper bridge plug;

said upper bridge plug is arranged for being pulled up to an upper setting target depth in said casing;

said upper bridge plug is arranged for being enabled by releasing said lock;

said upper bridge plug has an upper packer, said upper packer arranged for being set, said upper bridge plug having a through central bore, with an upper ball valve so as for allowing pressure integrity testing of the sealing effect of the upper packer from below by pressurizing the drill pipe string topsides, said upper bridge plug arranged for being shut by closing said upper ball valve; and said upper connector is arranged for disconnecting said upper bridge plug from said drill pipe string.

* * * * *